US005234239A

United States Patent [19]

Allenbaugh

[11] Patent Number: 5,234,239

[45] Date of Patent: Aug. 10, 1993

[54] SLIDING WINDOW BAR LOCK

[75] Inventor: Howard M. Allenbaugh, Huntington Beach, Calif.

[73] Assignee: M.A.G. Eng. & Mfg. Inc., Huntington Beach, Calif.

[21] Appl. No.: 859,679

[22] Filed: Mar. 30, 1992

[51] Int. Cl.[5] ..... E05C 17/32

[52] U.S. Cl. ..... 292/258; 292/263; 292/DIG. 46

[58] Field of Search ..... 292/258, 262, 263, 288, 292/343, DIG. 46

[56] References Cited

U.S. PATENT DOCUMENTS

| | | | |
|---|---|---|---|
| 2,510,303 | 6/1950 | Williamette | 292/263 |
| 3,282,618 | 11/1966 | Adickes | 292/258 |
| 3,328,920 | 7/1967 | Cohen et al. | 49/449 |
| 3,820,285 | 6/1974 | Shiffler et al. | 292/262 X |
| 3,993,336 | 11/1976 | Frost | 292/DIG. 46 |
| 4,062,576 | 12/1977 | Jennings et al. | 292/258 |
| 4,135,376 | 1/1979 | Evans et al. | 70/100 |
| 4,148,508 | 4/1979 | Adair | 292/258 |
| 4,248,461 | 2/1981 | Stevens | 292/218 |
| 4,461,502 | 7/1984 | Burgess | 292/262 |
| 4,570,985 | 2/1986 | Waldo et al. | 292/262 |
| 4,630,853 | 12/1986 | Bell | 292/258 |
| 4,674,779 | 6/1987 | Pratt | 292/263 |
| 4,699,407 | 10/1987 | Fortier | 292/263 |
| 4,792,168 | 12/1988 | Kardosh | 292/288 |
| 4,798,407 | 1/1989 | Miller | 292/DIG. 46 X |
| 4,971,374 | 11/1990 | Lovell et al. | 292/339 |

OTHER PUBLICATIONS

C & M Tool Brochure (one business card and 3 pages) Fremont, Calif.

Advertisement re the Churchill Mills Burglar Bar (1 page) (The Canadian Locksmith, Inc. vol. 9, No. 3, p. 49).

Advertisement re Charley-Bar Safety Lock (2 pages).

*Primary Examiner*—Richard E. Moore

*Attorney, Agent, or Firm*—Pretty, Schroeder, Brueggemann & Clark

[57] ABSTRACT

A locking device for securing a sliding window in either a fully closed or partially opened, vented position includes an elongated bar, a venting link and a clamp that attaches to the window channel. The bar may be attached to the clamp in either of two opposing orientations and thus may secure the window irrespective of whether the window opens to the left or the right. The bar is connected to the clamp by a retaining pin that engages a slot in the bar, and a spring-biased locking button on the clamp that engages one of two locking apertures in the bar.

15 Claims, 2 Drawing Sheets

FIG. 1.
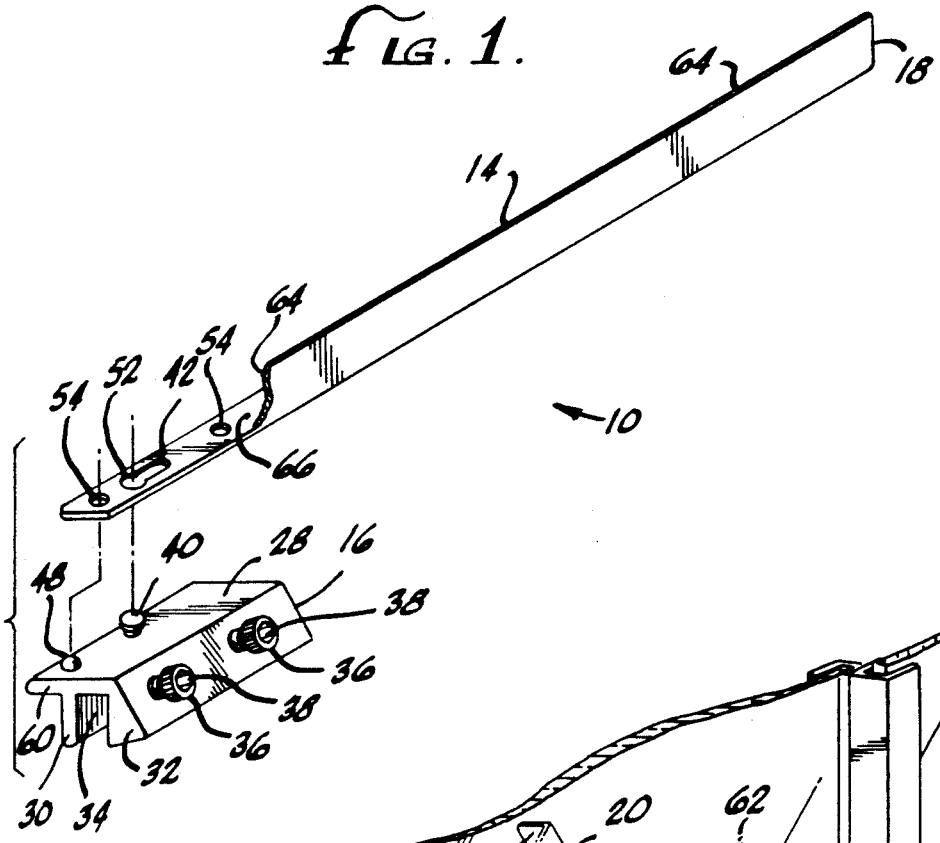
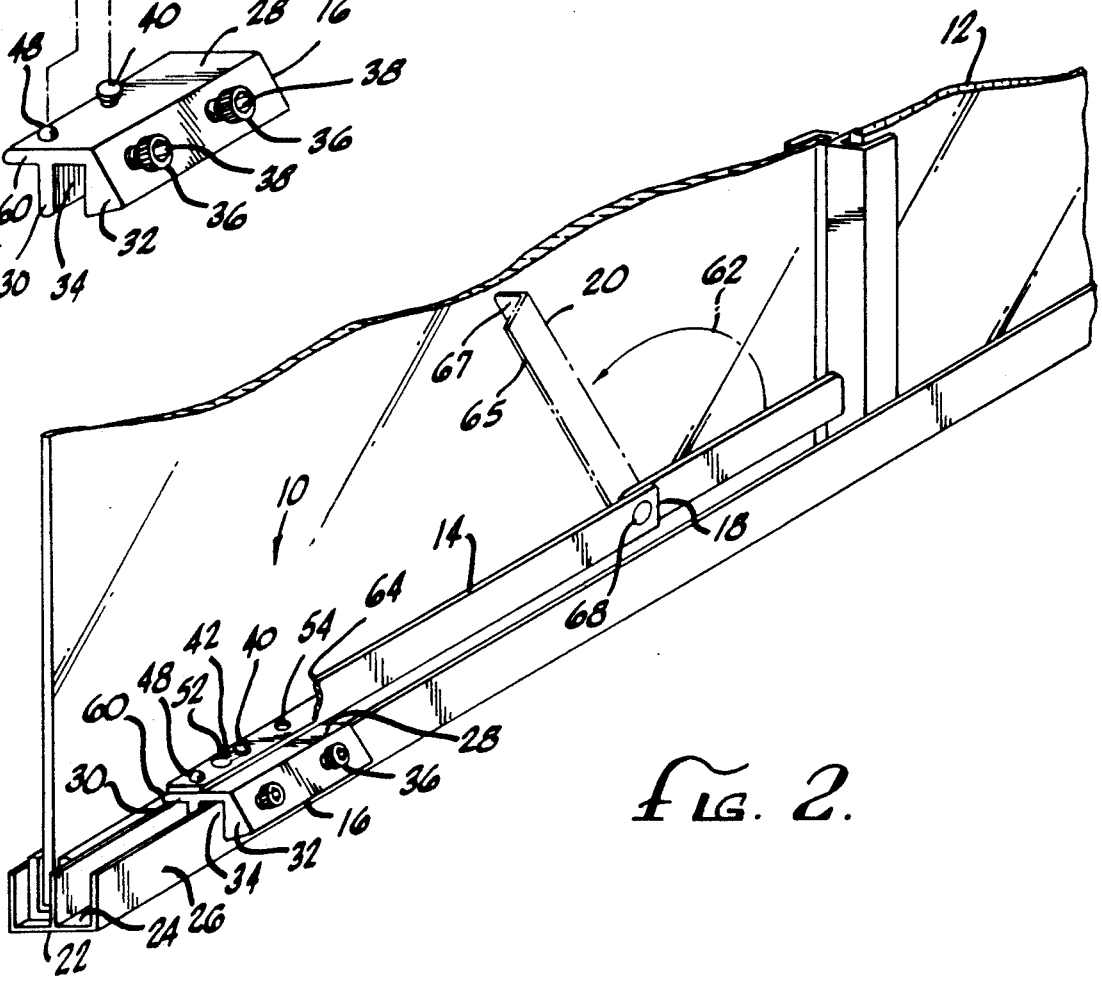
FIG. 2.

SLIDING WINDOW BAR LOCK

BACKGROUND OF THE INVENTION

The present invention relates to devices for securing sliding windows and the like in a fully closed or partially opened, vented position.

A sliding window generally has a primary locking mechanism to maintain the window in a closed position and to restrain it from being moved along a channel portion of the frame towards an open position. However, these locks may be quite easy to force open and is usually operable only when the window is in the closed position.

For these reasons, secondary locking devices exist which are employed to physically impede movement of the window within the channel. These secondary locks are easy to install and are typically removed from the access of a would-be intruder. In addition, many of these locks may be positioned to allow a selected amount of movement of the window towards the open position for venting, but to deny a would-be intruder sufficient access that could otherwise be gained by more fully opening the window.

One prior art secondary lock that has been proven somewhat effective is a clamp that attaches to a selected location within the channel and physically impedes the movement of the window. These clamps, however, must be attached with sufficient tenacity to avoid being forced loose by a would-be intruder. The required tenacity detracts from ready re-installation of the secondary lock to allow the window an adjustable range of movement or venting. In addition, installation of the aforementioned clamps may cause unsightly gouging to the window channel which is revealed if a clamp is re-installed at a different location in the channel. For these reasons, such locks typically are installed once only, either at a position immediately at the window's trailing edge so as to serve the function of a backup locking mechanism, or at a distance removed from the trailing edge of the window along the channel so as to allow the window a limited range of movement towards the open position for venting.

Another simple and common type of device for locking sliding windows comprises a relatively long and narrow bar of metal, wood or plastic loosely disposed in the bottom channel of the sliding window frame, between the sliding window and a vertical frame member, or abutment, so as to block the sliding movement of the window. The length of the bar is usually selected either to secure the window in a fully locked position, or to permit venting by allowing the window to be opened slightly before it encounters and is stopped by the bar. Some devices of this type have extensions which allow them to secure a window in either a fully closed or partially open, vented position.

The simplest such bar locks are comprised as elongated bars that are wedged between the trailing edge of the window and an abutment, or are otherwise positioned within the window's channel so as to allow the window a limited range of movement toward the open position. The more complicated bar locks, as mentioned, are telescopic or otherwise permit variations in their length to allow the occupant to select between desired degrees of venting or retention of the window in the closed position.

Devices of the types described above frequently possess certain drawbacks. For example, these devices are designed to stop the window by a bracing force applied against the bottom of the window. As a result, the window can sometimes be jarred and lifted over the device. Moreover, in the case of bar locks, the locking devices are not normally attached to either the window or the frame, and can sometimes be easily dislodged from the bottom channel of the window frame in which they rest, particularly when the window is opened for venting purposes. Also, the bar locks may need to be specifically tailored to a particular window, since the width of the bar relative to the window channel may facilitate dislodgement, or prevent usage with a relatively narrower window channel. While they may permit some length variation in the range of movement permitted to the window, alterations to the length of the bar are typically not easily accomplished, or are easily accomplished only at the expense of sturdiness or resistance to dislodgement.

The security problems that arise with respect to sliding doors or windows are particularly acute when venting is desired. Although the vent opening is typically too narrow for even a small child to pass through, it is usually sufficiently wide for someone to introduce a pole or other elongated implement for the purpose of dislodging the bar from either the bottom of the sliding window channel or from the cradle supporting the free end of the bar. Therefore, a significant disadvantage of existing bar-type devices for securing sliding windows and the like is that they are either fairly easily overridden and dislodged, or they are too elaborate, costly, and inconvenient to use.

From the foregoing, it should be apparent that a need exists for a simple, inexpensive device which is easy to install and use, for securing sliding windows and the like, and which will not be easily dislodged from the sliding window channel. This device should be rigidly retained in place whether the sliding window is fully locked or partially opened for venting purposes, and should be readily adaptable to lock a wide range of sliding windows. The present invention satisfies these needs and provides further related advantages.

SUMMARY OF THE INVENTION

The present invention provides a locking device for use with sliding windows or the like to secure the window in a fully closed or partially opened, vented position. The device comprises a bar having one end connected to a clamp that securely attaches the bar to a channel of the sliding window. The other free end of the bar abuts against the edge of the sliding window to restrain its movement.

The bar is attached to the clamp by a retaining pin on the clamp which fits in locking engagement within a narrow slot in the bar. More particularly, the pin has an enlarged head at its outer end and a narrower shaft connected to the clamp's upper surface, while the slot in the bar has an enlarged notch at one end of the slot. The retaining pin and its enlarged head are initially received through the enlarged notch of the bar such that the head protrudes past the notch. Thereafter, sliding movement of the bar with respect to the clamp causes the shaft of the pin to advance into the narrower slot, so that the bar is trapped between the enlarged head of the pin on one side and the upper surface of the clamp on the other. This movement of the bar with respect to the clamp also causes a spring biased locking button on the clamp to engage an aperture in the bar which maintains the retaining pin in a locked position within the slot. To remove the bar from the clamp, the bar is manipulated until the locking button is depressed and disengaged from the aperture, and the bar is then slid such that the retaining pin may be removed from the enlarged notch and the bar disconnected from the clamp.

In one aspect of the invention, the bar may be attached to the clamp from either side of the clamp. This advantageously allows the locking device to be installed on windows which open either to the left or to the right. In the preferred embodiment the clamp includes two apertures that are symmetrically located on opposite sides of the slot. In this way, the retaining pin may be locked within the slot, with the bar in either of two opposing orientations, with a locking button engaged with one of the locking apertures in the bar.

In another aspect of the invention, the bar may include a pivotally mounted venting link connected to the free end of the bar. The venting link and the bar are pivotally coupled such that the venting link may be pivoted outwardly to a locking position where it substantially aligns with the bar and restrains the window from any movement towards the open position. By pivoting the venting link inwardly and out of the locking position, the sliding window may be moved a limited distance towards the open position to permit venting, but is still restrained from complete movement towards the open position by the bar. Thus, the locking device of the present invention may be readily toggled to either lock the window in the totally closed position or in the partially open position to permit venting, without the need for readjustment of the clamp with respect to the channel.

The venting link and the bar are also coupled to allow stress to be substantially transferred at a point removed from a pivot axis where the venting link is connected to the bar. In the preferred embodiment, this is accomplished by providing both the venting link and the elongated bar with a substantially L-shaped cross section, comprising a horizontal portion and a vertical portion. The bar and venting link are connected to each other by a pivot pin extending through the vertical portions of each member. When the venting link is pivoted outwardly in the locking position, the ends of the horizontal portions abut each other such that stress may be substantially transferred between these horizontal portions, and not through the pivot pin. The L-shaped cross section is also advantageous in that it allows the venting link to be pivoted to a position where it is flush with the elongated bar.

As should be apparent, the present invention provides a reversible window locking device that may be readily attached to most sliding windows and which overcomes disadvantages of the prior art. Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view showing the various components of a first embodiment of a locking device embodying the novel features of the present invention, prior to assembly;

FIG. 2 is a perspective view of a sliding window that opens from the right to the left and which is secured by a second embodiment of the locking device;

DETAILED DESCRIPTION OF THE PREFERRED EMBODIMENT

Figure 3:
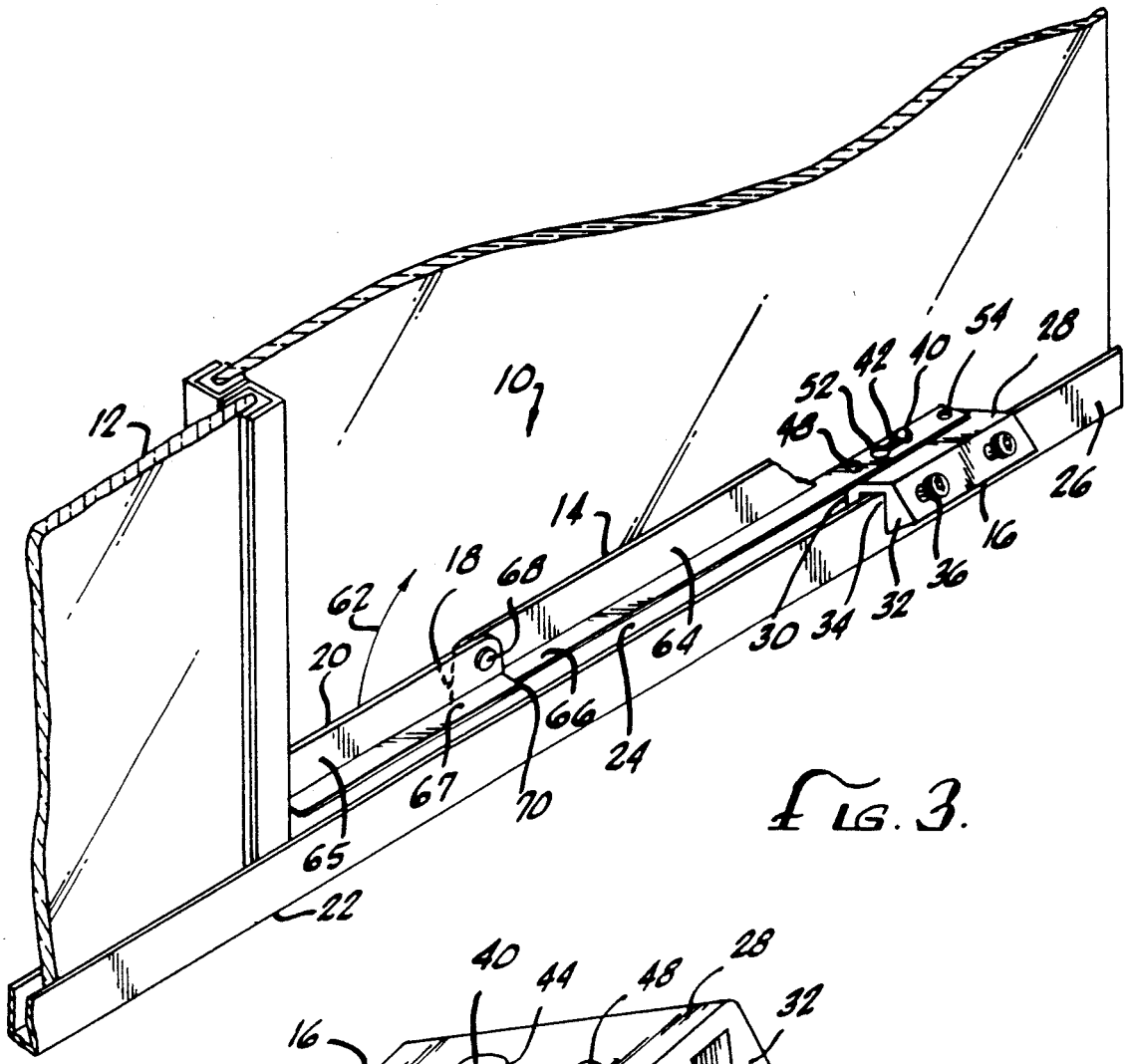
FIG. 3 is a perspective view of another sliding window secured by the locking device, similar to FIG. 2, but with a bar installed in reverse fashion to look the window, which opens from the left to the right.

As shown in the exemplary drawings, the present invention is embodied in a locking device, generally referred to by the reference numeral 10, for securing a sliding window 12 or the like in a fully closed or partially opened position. The device 10 comprises an elongated bar 14 having one end secured to a clamp 16 attached to the frame of the window 12. The other free end 18 of the bar 14 abuts against the vertical edge of the sliding window 12 to restrain it from movement to the open position. The bar 14 also includes an optional venting link 20 (shown in FIGS. 2–3) at the free end 18 which may be pivoted outwardly to maintain the window 12 in a fully closed position, or it may be pivoted and folded inwardly to permit the window to be opened a limited distance for venting purposes.

As shown in FIGS. 2 and 3, the device 10 is generally designed to secure a sliding window 12 having a window frame 22 and a channel 24 in which the window slides. The channel 24 includes an outer edge 26 comprising a vertical wall to which the clamp 16 is attached. As discussed in more detail below, the clamp 16 and the bar 14 are configured such that the locking device 10 may be connected either to windows that open from right to left, as shown in FIG. 2, or to windows that open from left to right, as shown in FIG. 3.

Figure 4:
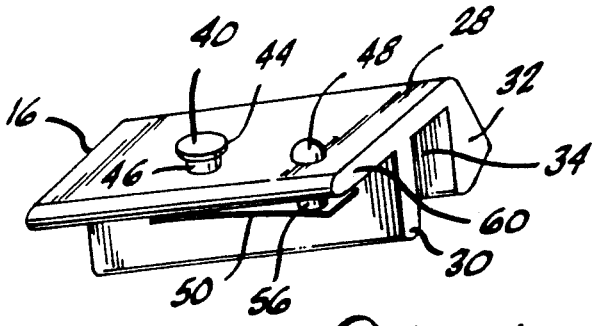
FIG. 4 is a perspective view of a clamp which forms a part of the locking device.
Figure 5:
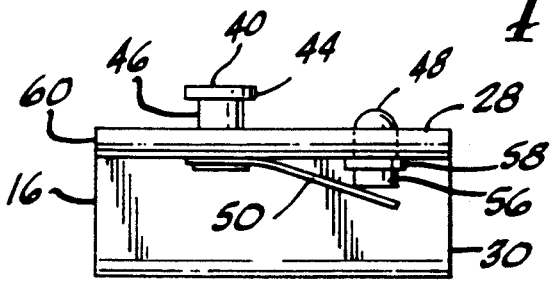
FIG. 5 is an elevational view of the clamp shown in FIG. 4.

With reference to the drawings, and particularly FIGS. 1 and 4, the clamp 16 comprises an upper surface 28, with a vertical inner wall 30 and a vertical outer wall 32 extending downwardly beneath the upper surface. The inner and outer walls 30 and 32 are spaced apart to form a groove 34 designed to receive the outer edge 26 of the window channel 24.

The clamp 16 is attached to the outer edge 26 of the window channel 24 by two screws 36 which are connected by threads through the outer wall 32 of the clamp. These screws 36 are rotated to clamp the outer edge 26 of the window channel 24 between the inner wall 30 of the clamp 16 and the ends of the two screws 36 protruding into the clamp's groove 34. In the preferred embodiment, the screws 36 have a wrench engaging region in the form of a hexagonal recess 38 which may be tightened or loosened by an appropriately sized Allen wrench (not shown). While it has been found that two screws 36 are sufficient to adequately secure the clamp 16 to the window channel 24 when the screws are tightened, additional screws may be provided if desired.

The bar 14 is attached to the clamp 16 by a retaining pin 40 on the upper surface 28 of the clamp which fits in locking engagement with a narrow slot 42 in the bar. More particularly, the retaining pin 40 comprises an enlarged head 44 having a narrower shaft 46 connected to the upper surface 28 of the clamp 16. The length of the shaft 46 is slightly greater than the thickness of the bar 14. The upper surface 28 of the clamp 16 also has a locking button 48 which is biased upwardly by a spring 50, as shown in FIG. 4. The narrow slot 42 in the bar 14 has an enlarged notch 52 at one end. The diameter of this notch 52 is slightly greater than the diameter of the enlarged head 44 of the pin 40. However, the transverse width of the narrow slot 42 is slightly smaller than the diameter of the enlarged head 44, yet slightly greater than the diameter of the pin's shaft 46. Two apertures 54 also are provided on the bar 14 at opposite ends of the slot 42.

The bar 14 is connected to the clamp 16 by initially inserting the enlarged head 44 of the retaining pin 40 through the enlarged notch 52 on the bar 14 until the bar is substantially flat against the upper surface 28 of the clamp 16. The bar 14 is then moved with respect to the clamp 16 such that the narrow shaft 46 slides into the slot 42. During the sliding movement, the contact of the bar 14 against the upper surface 28 of the clamp 16 depresses the locking button 48. This sliding movement is continued until the locking button 48 is received within one of the apertures 54 in the bar 14. At this point, the pin's shaft 46 will be completely within the slot 42, and the bar 14 will be clamped between the upper surface 28 of the clamp 16 on one side and the enlarged head 44 of the pin 40 on the other.

Rotational and sliding movement of the bar 14 with respect to the clamp 16 is inhibited by the locking button 48 which is forced into one of the apertures 54 by the spring 50. With reference to FIG. 4, the locking button 48 comprises an elongated rod 56 which passes through a hole in the clamp 16. The rod 56 has an outer end with a rounded configuration which extends from the upper surface 28 of the clamp 16 for engagement with one of the apertures 54. The other inner end of the rod 56 extends to the opposite side of the clamp 16 and has a retaining ring 58 with a diameter larger than the hole through which the rod passes. The retaining ring 58 thus controls the distance by which the outer end of the rod 56 extends outwardly from the upper surface 28 of the clamp 16. One end of the spring 50 is secured to the clamp 16 by the retaining pin 40, and the other end of the spring 50 contacts the inner end of the rod 56 and normally biases the rod outwardly with respect to the clamp. In the preferred embodiment, the spring 50 comprises a leaf spring, but any other suitable spring may be used.

The structural relationship between the pin 40, slot 42, locking button 48 and apertures 54 is such that the pin's shaft 46 will substantially abut the end of the slot 42 opposite the notch 52 at the time the locking button 48 is received within one of the apertures 54. Thus, with reference to FIG. 2, if an intruder attempts to open the sliding window 12 from right to left, the contact between the end of the slot 42 and the pin's shaft 46 would provide additional resistance to sliding movement between the bar 14 and the clamp 16. While the connection between the locking button 48 and one of the apertures 54 is sufficient to resist sliding movement of the bar 14 in most instances, the configuration described above provides additional protection.

It is noted that the clamp's inner wall 30 joins the upper surface 28 of the clamp 16 at about the mid-point of the upper surface. This allows a portion of the clamp 16 to extend like a ledge 60 over the window channel 24. This enables the bar 14 to be connected substantially over the window channel 24 and in an elevated position with respect to the channel. As a result of this elevated position, it is very difficult for an intruder to lift the window 12 and slide it over the bar 14. This provides further protection against attempts to defeat the locking device 10 to gain unwanted entry.

As mentioned above, the relative positions of the retaining pin 40 and the locking button 48 are such that, when the bar 14 is coupled to the clamp 16 as shown in FIGS. 2 or 3, the locking button 48 will engage a locking aperture 54 at the same time the retaining pin 40 is fully within or at the end of the notch 52. In this position, the spring 50 forces the locking button 48 into one of the locking apertures 54 to prevent sliding movement between the retaining pin 40 and the slot 42 until and unless the spring 50 is biased downwards to permit disengagement of the locking button 48 from the locking aperture 54. Once the locking button 48 is disengaged, the retaining pin 40 may be moved relative to the slot 42 such that the pin head 44 may be withdrawn from the slot 42 via the enlarged notch 52.

As shown in FIGS. 2 and 3, the presence of two locking apertures 54 in the bar 14 on opposite sides of the slot 42 permits the bar 14 to be coupled to the clamp 16 in either of two opposing orientations. Each locking aperture 54 is positioned at a fixed distance from the slot 42 corresponding to the distance between the retaining pin 40 and the locking button 48. In this way, the bar 14 can be connected to the clamp 16 in either of two opposing orientations. Thus, as shown in FIG. 2, the bar 14 can be connected to the clamp 16 in one orientation to secure a window 12 that opens from right to left. Alternatively, as shown in FIG. 3, the bar 14 can be connected to the clamp 16 in a second orientation to secure a window 12 that opens from the left to the right.

The pivotally mounted venting link 20 noted above allows selective locking and venting of the window 12 once the device is installed. The link 20 is coupled to the free end 18 of the bar 14 opposite the clamp 16 and is movable between a locking position, in which it is pivoted outwardly towards the sliding window 12, as shown in FIGS. 2 and 3, and a venting position, in which the link 20 is pivoted away from the sliding window 12 to permit venting, as indicated by the arrows 62 in FIGS. 2 and 3.

The bar 14 has a substantially L-shaped cross-section having a vertical side portion 64 and a horizontal bottom portion 66. Similarly, the venting link 20 has a substantially L-shaped cross-section having a vertical side portion 65 and a horizontal bottom portion 67. The bar 14 and venting link 20 are pivotally coupled at a pivot axis defined by a pivot pin 68, such that pivotal movement occurs within the plane of movement of the sliding window 12, as shown in FIG. 2. The pivot pin 68 is therefore mounted at an overlap between the vertical portions 64 and 65 of the bar 14 and the venting link 20. Terminal edges 70 of the horizontal portions 66 and 67 of the bar 14 and the venting link 20 are designed to abut each other when the venting link 20 is in the locking position, as shown in FIG. 3, so that any applied longitudinal force, for example, by attempting to open the window 12, is substantially transferred by the terminal edges 70 of the horizontal portions 66 and 67 and is not applied to the pivot pin 68.

A significant advantage of the locking device 10 is that it may be secured to virtually any size window 12. Hence, it is not necessary to worry about the width of the window 12 in relation to the width of the bar 14, since the clamp 16 simply fits over the window channel 24 and then is moved until the free end 18 of the bar 14

(or the end of the optional venting link 20) abuts the vertical edge of the window 12. At that point, the clamp 16 is securely attached to the outer edge 26 of the window channel 24, a single time, to permit convenient locking and venting of the window 12. Since the clamp 16 only needs to be secured to the window channel 24 a single time, to allow both locking and venting of the window 12, it is not necessary to continually loosen and tighten the clamp to accomplish these locking and venting features. As a result, unsightly gouging of the window channel 24 is avoided.

The locking device 10 of the present invention advantageously functions as a three position lock. In one position, the end of the venting link 20 abuts the vertical edge of the window 12 to secure the window in a fully closed, locked condition. In a second position, the venting link 20 is pivoted to the venting position to allow the window to be opened slightly, say about three inches, for venting purposes. In a third position, the entire bar 14 may be removed, leaving the clamp 16 to stop travel of the window 12. In this last position, the window 12 may be opened to a width corresponding to about the width of the bar 14 and venting link 20, say about eleven inches.

The locking device 10 may be manufactured using conventional manufacturing techniques. All of the components of the device preferably are manufactured from metal. The bar 14 and venting link 20 preferably are bent into their L-shape cross-section by traditional bending techniques, and the slot 42 and enlarged notch 52 are preferably formed by stamping techniques. The clamp 16 and its various components may be formed by machining or cast techniques. Thus, the locking device 10 is quite durable and sturdy, yet relatively lightweight, simple and inexpensive to manufacture.

From the foregoing, it will be appreciated that the present invention provides a locking device 10 which may be conveniently toggled between locked and venting positions and which positively secures the device 10 to the window channel 24 to prevent dislodgement of the bar 14 and unwanted entry. The locking device 10 therefore eliminates the need for continual repositioning of the clamp 16 to allow selective venting, and thus avoids unsightly gouging of the window frame 22. The device 10 also provides a convenient clamping feature that allows the bar 14 to be connected to the clamp 16 in either of two opposing orientations to accommodate windows 12 that open either from the left or the right. Also, the design of the device 10 permits the bar 14 to be mounted slightly above the sliding window channel 24 to prevent the window 12 from being lifted and slid over the device 10, yet provides sturdy construction and an unobtrusive venting link 20 when pivoted away from the sliding window 12.

While a particular form of the invention has been illustrated and described, it will be apparent that various modifications can be made without departing from the spirit and scope of the invention. Therefore, it is not intended that the invention be limited, except as by the appended claims.

I claim:

1. A locking device for locking a sliding window in relation to a window frame, the locking device comprising:

(a) an elongated bar having a free end adapted to abut against the window;

(b) a clamp secured to the window frame; and (c) means for securing the bar to the clamp to thereby restrain sliding movement of the window, wherein the means for securing the bar to the clamp comprises:

a retaining pin on the clamp having an enlarged head at its outer end and a narrower shaft at its inner end connected to the clamp;

a locking button on the clamp that is normally biased outwardly with respect to the clamp;

a slot in the bar that is dimensioned to receive only the shaft of the pin, with an enlarged notch in the slot that is dimensioned to receive the enlarged head of the pin; and an aperture in the bar that is dimensioned to receive the locking button when the shaft of the pin is within the slot, with the enlarged head of the pin on one side of the bar and the clamp on the other side of the bar.

2. The locking device of claim 1, wherein the distance between the shaft of the pin and the locking button on the clamp is substantially the same as the distance between the aperture in the bar and the end of the slot opposite the enlarged notch.

3. The locking device of claim 2, wherein there are two apertures in the bar on opposite sides of the slot to thereby allow the bar to be secured to the clamp in either of two opposing orientations.

4. The locking device of claim 1, wherein the pin's shaft and enlarged head are cylindrical.

5. The locking device of claim 4, wherein the width of the slot is greater than the diameter of the shaft but is smaller than the diameter of the enlarged head of the pin.

6. The locking device of claim 1, wherein the locking button is biased outwardly with respect to the clamp by a spring.

7. The locking device of claim 1, wherein the locking button comprises:

(a) an elongated rod passing through a hole in the clamp such that an outer end of the rod having a rounded end extends outwardly from one side of the clamp, with the other inner end of the rod extending to another opposite side of the clamp;

(b) a retaining ring on the inner end of the rod to control the distance by which the outer end of the rod extends outwardly from the one side of the clamp; and (c) a spring on said opposite side of the clamp which contacts the inner end of the rod and normally biases the rod outwardly with respect to the clamp.

8. The locking device of claim 7, wherein the spring comprises a leaf spring having one end urging against the inner end of the rod and another end connected to the clamp by the retaining pin.

9. The locking device of claim 1, further comprising a venting link pivotally connected to the free end of the bar, such that when the venting link is pivoted outwardly away from the bar the venting link contacts the window and restrains it from sliding movement, and such that when the venting link is pivoted inwardly toward the bar the window may be opened a limited distance for venting purposes until the window contacts the free end of the bar.

10. The locking device of claim 9, wherein the bar and the venting link each have an L-shaped cross-section, with a vertical portion and a horizontal portion.

11. The locking device of claim 10, wherein the vertical portion of the venting link is pivotally connected by a pivot pin to the vertical portion of the bar, and wherein the horizontal portions of the bar and the venting link are adapted to abut against each other, to distribute applied longitudinal forces along the horizontal portions of the bar and the venting link and not on the pivot pin, when the venting link is pivoted outwardly away from the bar.

12. The locking device of claim 9, wherein the venting link is connected to the bar about a horizontal pivot axis, and wherein the venting link contacts the bar such that any longitudinal forces applied to the venting link when it is pivoted outwardly away from the bar will be transferred to the bar at a point removed from said pivot axis.

13. A locking device for locking a sliding window in relation to a window frame, the locking device comprising:

(a) an elongated bar having a free end adapted to abut against the window;

(b) a venting link pivotally connected to the free end of the bar, such that when the venting link in pivoted outwardly away from the bar the venting link contacts the window and restrains it from sliding movement, and such that when the venting link is pivoted inwardly toward the bar the window may be opened a limited distance for venting purposes until the window contacts the free end of the bar, wherein the venting link is connected to the bar about a horizontal pivot axis, and wherein the venting link contacts the bar such that any longitudinal forces applied to the venting link when it is pivoted outwardly away from the bar will be transferred to the bar at a point removed from said pivot axis;

(c) a clamp secured to the window frame; and (d) means for securing the bar to the clamp to thereby restrain sliding movement of the window.

14. The locking device of claim 13, wherein the bar and the venting link each have an L-shaped cross-section, with a vertical portion and a horizontal portion.

15. The locking device of claim 14, wherein the vertical portion of the venting link is pivotally connected by a pivot pin to the vertical portion of the bar, and wherein the horizontal portions of the bar and the venting link are adapted to abut against each other, to distribute applied longitudinal forces along the horizontal portions of the bar and the venting link and not on the pivot pin, when the venting link is pivoted outwardly away from the bar.

* * * * *